US007086160B2

(12) United States Patent
Coffin et al.

(10) Patent No.: US 7,086,160 B2
(45) Date of Patent: Aug. 8, 2006

(54) BIDIRECTIONAL SHAVING IMPLEMENT

(75) Inventors: David C. Coffin, Hamden, CT (US); Randy Nicolosi, Shelton, CT (US); Andrew J. Pennella, Stamford, CT (US); Paul D. Richard, Shelton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/768,609

(22) Filed: Jan. 30, 2004

(65) Prior Publication Data

US 2004/0261271 A1 Dec. 30, 2004

Related U.S. Application Data

(63) Continuation-in-part of application No. 10/686,992, filed on Oct. 16, 2003, now abandoned.

(60) Provisional application No. 60/420,273, filed on Oct. 21, 2002.

(51) Int. Cl.
*B26B 21/52* (2006.01)
*B26B 21/22* (2006.01)

(52) U.S. Cl. ..... 30/532; 30/527; 30/50

(58) Field of Classification Search ..... 30/47, 30/50, 77, 526, 527, 532, 528, 48
See application file for complete search history.

(56) References Cited

U.S. PATENT DOCUMENTS 3,488,764 A * 1/1970 Welsh ..... 30/50
3,935,639 A 2/1976 Terry et al.
4,603,477 A * 8/1986 Francis ..... 30/50
4,791,724 A * 12/1988 Dumas ..... 30/526
4,970,784 A 11/1990 Althaus et al.
5,084,968 A * 2/1992 Trotta ..... 30/47
5,579,580 A * 12/1996 Althaus et al. ..... 30/50
5,636,442 A 6/1997 Wain
6,141,875 A * 11/2000 Andrews ..... 30/50
6,161,288 A * 12/2000 Andrews ..... 30/50
6,223,442 B1 * 5/2001 Pina ..... 30/527
2004/0231161 A1 * 11/2004 Coffin et al. ..... 30/50

FOREIGN PATENT DOCUMENTS

| | | | |
|---|---|---|---|
| DE | 2803371 | A1 | 8/1978 |
| GB | 2155383 | A | 9/1985 |
| WO | WO96/32232 | A | 10/1996 |
| WO | WO2004/073942 | A | 9/2004 |
| WO | WO2004/087382 | A | 10/2004 |

* cited by examiner

*Primary Examiner*—Hwei-Siu Payer
(74) *Attorney, Agent, or Firm*—Michaud-Duffy Group LLP

(57) ABSTRACT

In a razor cartridge, a platform portion has a first cartridge section that includes at least one first pair of razor blades position therein. Each of the first pair or razor blades has an at least partially exposed cutting edge. A second cartridge section is also provided and is coupled to the platform portion. The second cartridge section includes at least one pair of second razor blades positioned therein, each of the second pair of razor blades also has an at least partially exposed cutting edge. The razor cartridge can be mounted either temporarily or permanently to a handle and the cutting edges of each of the first and second pair of razor blades face one another so that during a shaving operation, the razor cartridge can cut hair when drawn over a user's skin in either of two generally opposite directions.

32 Claims, 4 Drawing Sheets

BIDIRECTIONAL SHAVING IMPLEMENT

CROSS REFERENCE TO RELATED PATENT APPLICATIONS

This patent application is a continuation-in-part of U.S. patent application Ser. No. 10/686,992, entitled, "Bidirectional Shaving Cartridge and Razor Including Same," filed on Oct. 16, 2003, now abandoned, claiming priority to Provisional Patent Application No. 60/420,273 filed on Oct. 21, 2002, the disclosures of which are incorporated in their entirety by reference herein.

FIELD OF THE INVENTION

The present invention generally relates to wet shaving implements and is more particularly directed to a shaving implement able to cut hair when drawn over a user's skin in either of two generally opposite directions.

BACKGROUND OF THE INVENTION

Wet shaving razors typically incorporate razor cartridges that have one or more razor blades mounted in a housing with each razor blade having an exposed cutting edge. Generally, the razor can only be drawn in a single direction over a user's skin to cut hair and must be repositioned for each subsequent stroke. When shaving large areas, like the surface of a leg, the need to reposition the shaving implement increases the time required to complete a shaving operation. Another difficulty can occur when shaving hard to reach areas that have complex contours, such as, for example, an armpit. It can become cumbersome to reposition the razor prior to each stroke. Based on at least these difficulties, there is a need for a razor, the use of which does not require that the razor be repositioned prior to each stroke.

In an effort to address the above-described problems and drawbacks wet shave razors were developed wherein two or more blades were positioned in a razor cartridge so that the cutting edges of the blades faced away from one another. Shaving implements configured in this fashion were capable of cutting hair when drawn over a user's skin in either of two generally opposite directions. However, due to the blades facing away from each other, and the fact that no friction reducing materials were employed in the razor, significant amounts of drag and thereby discomfort resulted as the razor was drawn across the user's skin.

Another problem associated with prior art razors configured in the above-described manner was that they either did not pivot at all, or the range of pivotal motion, relative to the handle on which the cartridge was mounted, was insufficient to allow the cutting edges of the razor blades to follow the contours of the user's skin and to allow for an effective reversal of the cutting direction.

Another drawback associated with the aforementioned prior art, outwardly facing, opposed blade systems is that during a shaving operation, the line of action of the force that moves the blades in the direction of the cut pushes the blade. This has the potential to cause blade chatter or overturning moments. Either of these occurrences can result in an uncomfortable shaving experience.

Another difficulty encountered when using the prior art razors sometimes occurred when a user reversed the stroke direction. Often this resulted in a slightly sideways movement of the blades against the user's skin. Because the cutting edges of the blades were generally completely exposed this motion resulted in nicking or cutting of the skin.

Based on the foregoing, it is the general object of the present invention to provide a wet shave razor that overcomes or improves upon the problems and drawbacks associated with prior art shaving implements.

SUMMARY OF THE PRESENT INVENTION

The present invention is directed in one aspect to a razor cartridge that includes a platform portion having first and second cartridge sections. The first cartridge section includes at least one first pair of razor blades positioned therein, each having an at least partially exposed cutting edge. Similarly, the second cartridge section includes at least one second pair of razor blades positioned therein, each also having an at least partially exposed cutting edge. Mounting means are provided for releasably coupling the platform portion, and thereby the razor cartridge, to a handle. The cutting edges of the first pair of razor blades and the cutting edges of the second pair of razor blades are positioned generally opposite and facing toward one another, thereby enabling the cartridge to cut hair when moved over a user's skin in either of two generally opposite directions.

In the preferred embodiment of the present invention, the platform portion and the first and second cartridge sections are integral with one another. However, the present invention is not limited in this regard as the cartridge sections can also be releasably or permanently coupled to the platform portion without departing from the broader aspects of the present invention. First and second limiting surfaces are located on an underside of the platform portion adjacent to one end. Third and forth limiting surfaces are also positioned on the underside of the platform portion and are located adjacent to an opposing end thereof. The limiting surfaces are configured so as to establish a range of rotational movement of the razor cartridge when rotatably mounted on a razor handle. The limiting surface contact portion of the handle limits cartridge rotation. Preferably, the range of rotational movement is between approximately 0° and 90°. However, the present invention is not limited in this regard as other rotational ranges that are more than, or less than 90° can be employed.

Preferably, the platform portion defines a plurality of apertures to allow shaving debris to be washed through and out of the razor cartridge. In addition, the first cartridge section includes a first housing and the second cartridge section includes a second housing. A first blade retainer having the first pair of razor blades coupled thereto is positioned in the first housing for movement between a neutral position and a retracted position in response to forces generated during a shaving operation. Likewise, a second blade retainer having the second pair of razor blades coupled thereto is positioned in the second housing for movement between a neutral position and a retracted position in response to forces generated during the shaving operation. Biasing means are located in each of the first and second housings for normally urging the first and second blade retainers toward the neutral position.

Preferably, the first and second cartridge sections define a gap there between. In an embodiment of the present invention a first guard element is coupled to the first housing, and a second guard element is coupled to the second housing. In general, during a shaving operation, the guard elements act to stretch the user's skin thereby providing a surface more conducive to cutting hair. The razor cartridge of the present invention can also include at least one comfort strip. Preferably, two comfort strips would be provided, one coupled to each of the first and the second cartridge sections. In addition, at least one comfort strip can be positioned in the gap between the first and second cartridge sections. However, the present invention is not limited in this regard as any number of comfort or glide strips can be attached to the razor cartridge without departing from the broader aspects of the present invention.

In another aspect, the present invention resides in a shaving implement incorporating the above-described razor cartridge either permanently or releasably coupled to a handle. In this instance, the razor cartridge preferably has a range of rotation relative to the handle, due to the orientation of the above-described limiting surfaces from a neutral position to approximately 70°. A biasing member projects outwardly from the handle and engages an abutment surface on the platform portion of the razor cartridge to normally urge the razor cartridge toward a neutral position.

DETAILED DESCRIPTION OF THE PREFERRED EMBODIMENTS OF THE PRESENT INVENTION

Figure 1:
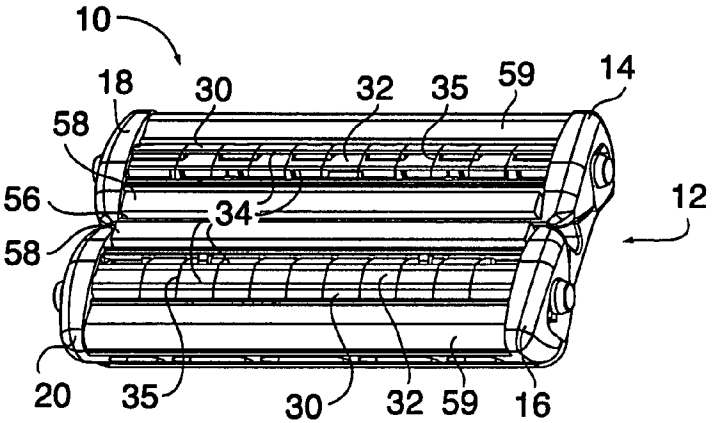
FIG. 1 is a perspective view of a razor cartridge configured in accordance with the present invention.
Figure 3:
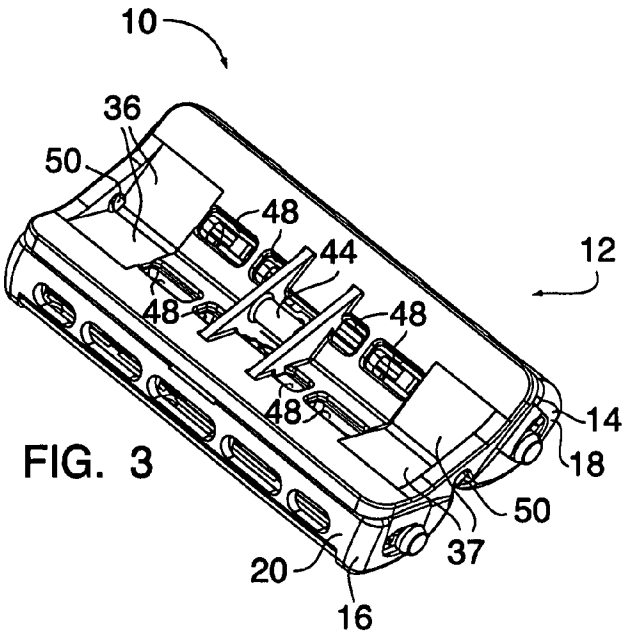
FIG. 3 is a perspective view of the underside of the razor cartridge of FIG. 1.
Figure 2:
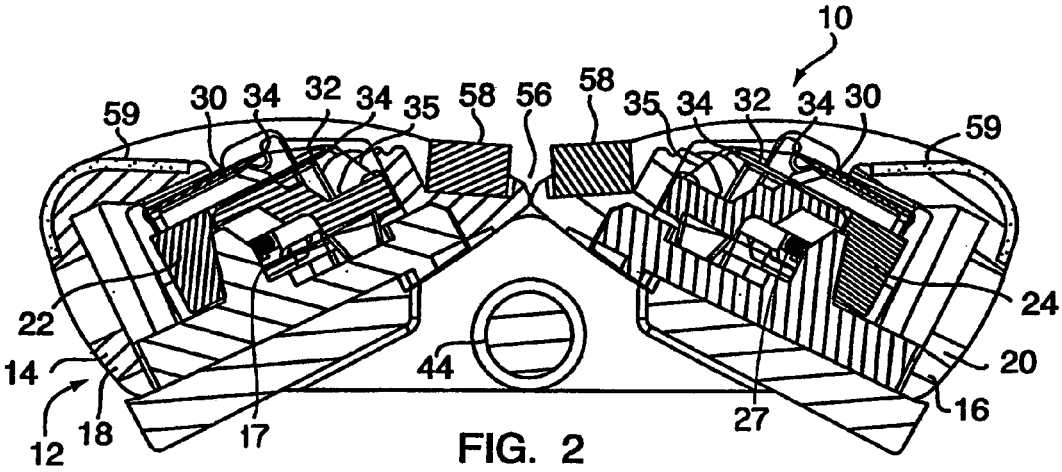
FIG. 2 is a cross-sectional side view of the razor cartridge of FIG. 1.
Figure 6:
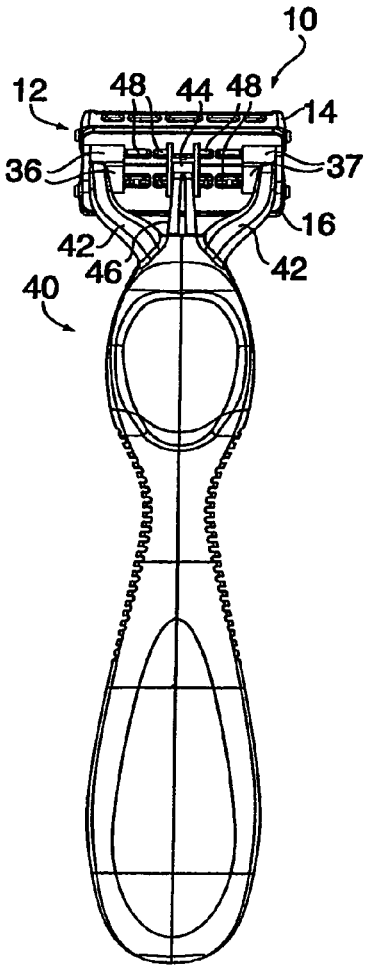
FIG. 6 is a rear view of a shaving implement showing the razor cartridge of FIG. 1 coupled to the handle of FIG. 4.

As shown in FIGS. 1–3, a razor cartridge embodying the present invention and generally designated by the reference number 10 includes a platform portion 12 having first and second cartridge sections, 14 and 16 respectively, mounted thereon. The first cartridge section 14 includes a first housing 18, and the second cartridge section 16 includes a second housing 20. A first blade retainer 22, best seen in FIG. 2, is positioned in the first housing 18, and a second blade retainer 24 is positioned in the second housing 20. The first and second blade retainers, 22 and 24 respectively, are each movable between a neutral position, where the blade retainers are positioned closest to the leading edges of the first and second blade housings, 18 and 20 respectively, and a retracted position where the blade retainers are located away from the leading edges. A spring 17, 27 is positioned in each cartridge section to normally urge the blade retainers toward the neutral position. The first and second cartridge sections, 14 and 16 respectively, have been described as being mounted on the platform portion 12, the term "mounted" should be broadly construed to mean, integral with the platform portion, permanently coupled to it, or releasably coupled to it.

As best shown in FIG. 2, a pair of razor blades 30 and 32 is mounted to each of the first and the second blade retainers, 22 and 24 respectively, each razor blade having an at least partially exposed cutting edge 34. The razor blades 30 and 32 are positioned in the first and second blade retainers, 22 and 24 respectively, so that the cutting edges 34 are spaced apart and offset relative to one another. In addition, the cutting edges 34 of the razor blades 30 and 32 mounted in the first blade retainer 22 generally face toward the cutting edges of the razor blades mounted in the second blade retainer 24. In this manner the razor cartridge 10 can cut hair by being drawn over a user's skin in either of two generally opposite directions. While each cartridge section, 14 and 16, has been described as having a pair of razor blades positioned therein, the present invention is not limited in this regard as any number of razor blades can be incorporated into each cartridge section. Moreover, the number of blades can differ between cartridge sections without departing from the broader aspects of the present invention.

Referring to FIG. 1, the first and second pair of razor blades 30, 32 are wrapped with wire 35 that extends over the cutting edges 34 to limit the amount by which a user's skin can extrude between successive razor blades. While wire wrapped razor blades have been shown and described, the present invention is not limited in this regard as other features for inhibiting skin extrusions known to those skilled in the pertinent art to which the present invention pertains, such as, but not limited to protuberances between successive blades, can be substituted.

Figure 7:
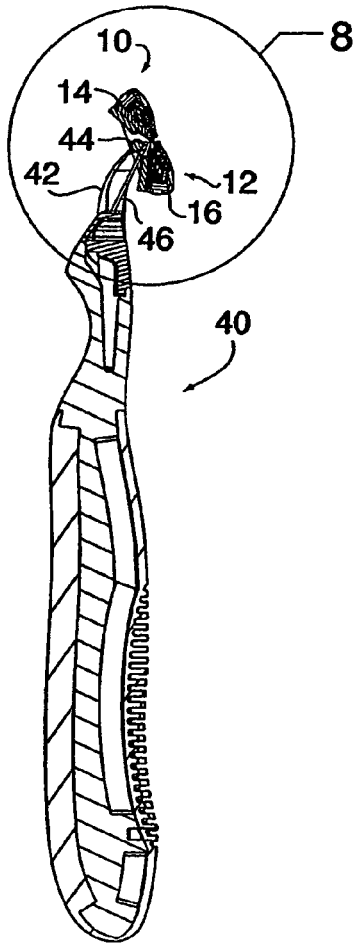
FIG. 7 is a cross-sectional side view of the shaving implement of FIG. 6.
Figure 8:
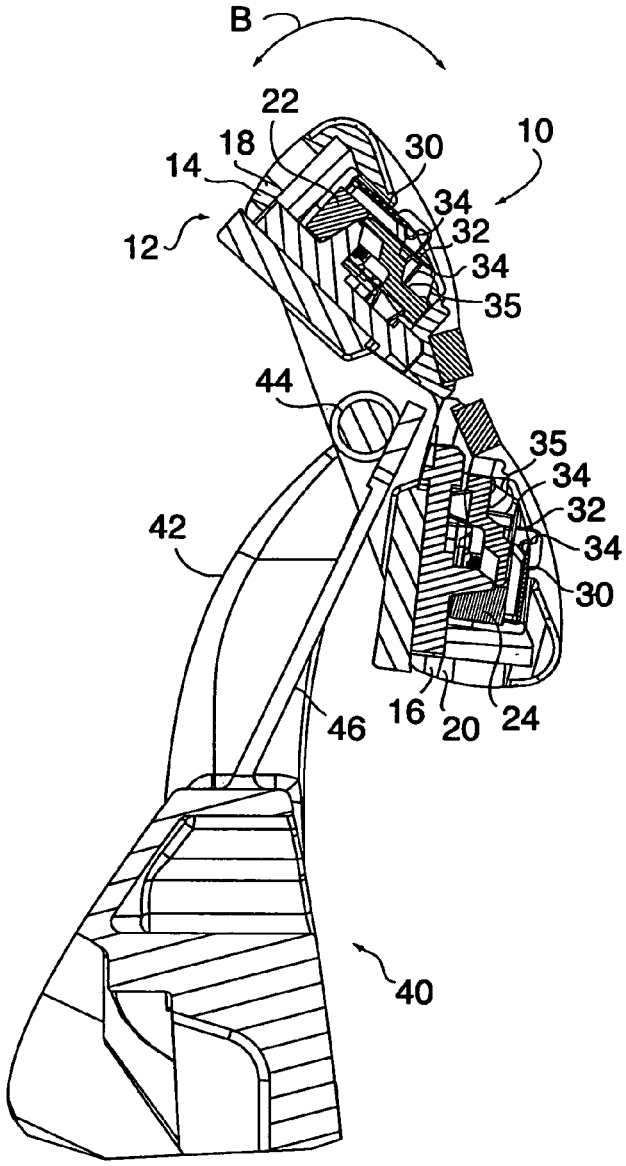
FIG. 8 is an enlarged view of a portion, bounded by the circle labeled "8" of the shaving implement of FIG. 7.
Figure 9:
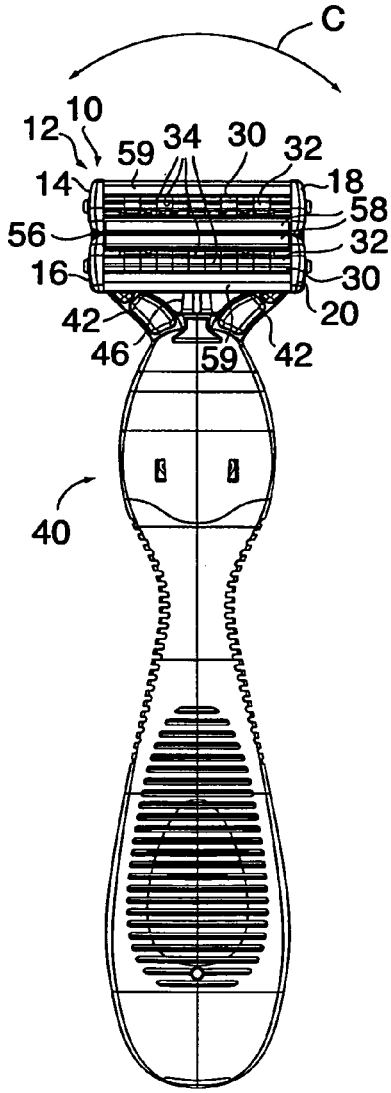
FIG. 9 is a front view of the shaving implement of FIG. 6.

Referring to FIGS. 3, and 7–9, the platform portion 12 includes first and second limiting surfaces generally designated by the reference number 36 located at one end of the platform portion and third and fourth limiting surfaces generally designated by the reference number 37 located at a generally opposite end of the platform portion. When the razor cartridge 10 is rotatably mounted on a handle 40 the limiting surfaces 36 and 37 act to inhibit the range of rotation of the razor cartridge relative to the handle by engaging mounting arms 42 that extend from the handle. Preferably, the range of rotation of the razor cartridge 10 is forward and rearward between a neutral position as shown in FIGS. 7–9 and a fully rotated position (not shown) and is between approximately 70° to 90° as indicated by the arrows labeled "B" in FIG. 8. However, the present invention is not limited in this regard as the range of motion can be 0° or any other angular amount without departing from the broader aspects of the present invention, In addition to moving in a forward and rearward motion when mounted on a razor handle, the shaving implement may also be configured to allow the razor cartridge to move in a side-to-side rotation as indicated by the arrows labeled "C" in FIG. 9. Cardanic motion is achieved when the razor cartridge is movable in a forward and rearward direction simultaneously with side-to-side motion.

Figure 4:
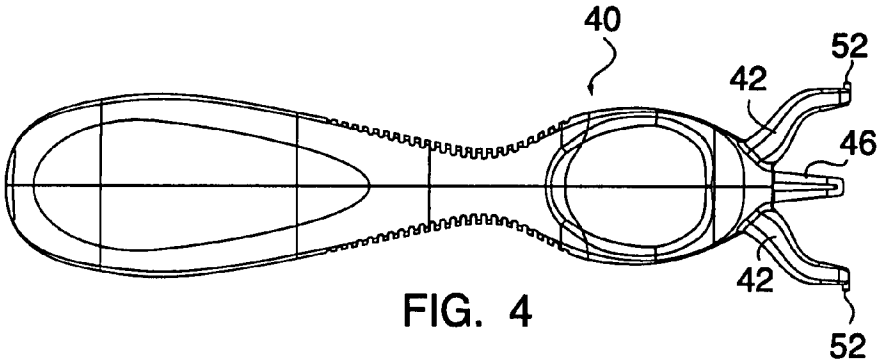
FIG. 4 is a front view of a razor handle attachable to the razor cartridge of FIG. 1.
Figure 5:
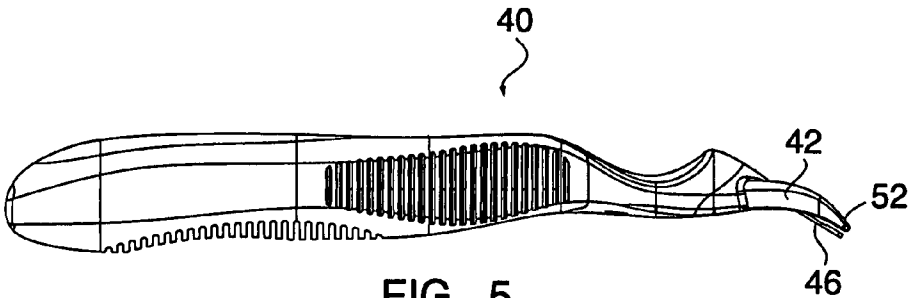
FIG. 5 is a side view of the handle of FIG. 4.

Referring now to FIGS. 3 and 8, the platform portion 12 includes an abutment surface 44, shown in the illustrated embodiment as being circular in cross section, however, the invention is not limited in this regard. When the razor cartridge is mounted, either permanently or releasably to the handle 40, FIGS. 4 and 5, a resilient biasing member 46 projecting outwardly from the handle, engages the abutment surface 44 and normally urges the razor cartridge 10 toward the neutral position. The platform portion 12 also includes a plurality of apertures 48 that aid in allowing shaving debris to be washed through the razor cartridge 10 during a shaving operation. Furthermore, the platform portion 12 includes a pair of opposed recesses 50 each adapted to slidably receive an end 52 of mounting arms 42 that form part of the handle 40. Mounting arms 40 can be movable to allow a disposable razor cartridge to be releasably mounted to the handle 40, or they can be fixed and the razor cartridge mounted permanently thereon. While recesses 50 and mounting arms have been shown and described, the present invention is not limited in this regard as other means of mounting a razor cartridge to a handle, known to those skilled in the particular art to which the invention pertains, can be substituted. For example, the razor cartridge and handle can be configured to snappingly engage one another, or shell bearings can be employed.

Referring to FIGS. 1, 2 and 9, the first and second cartridge sections, 14 and 16 respectively, define a gap 56 there between. In addition, a guard element 58 is coupled to each of the first and second housings, 14 and 16 respectively, adjacent to the leading edges thereof. During a shaving operation, the guard elements 58 aid in stretching the skin prior to contact with the cutting edges of the razor blades. Comfort strips 59 can also be provided on the first and second housings, 18 and 20 respectively and/or in the gap 56 between the first and second cartridge sections, 14 and 16 respectively. The comfort strips can incorporate a shaving aid thereon such as, but not limited to Polyox®, aloe, vitamins, gels, or oils, or they can incorporate a low friction material to reduce discomfort during a shaving operation. When the comfort strips 59 are formed from low friction material they are referred to by those skilled in the pertinent art to which the present invention pertains, as "glide strips." While guard elements 58 and comfort strips 59 have been shown as being mounted to the razor cartridge 10 in a particular configuration, the present invention is not limited in this regard. The guard elements 58 and comfort strips 59 can be omitted, interchanged or positioned in any combination on the razor cartridge 10 without departing from the broader aspects of the present invention.

Figure 10:
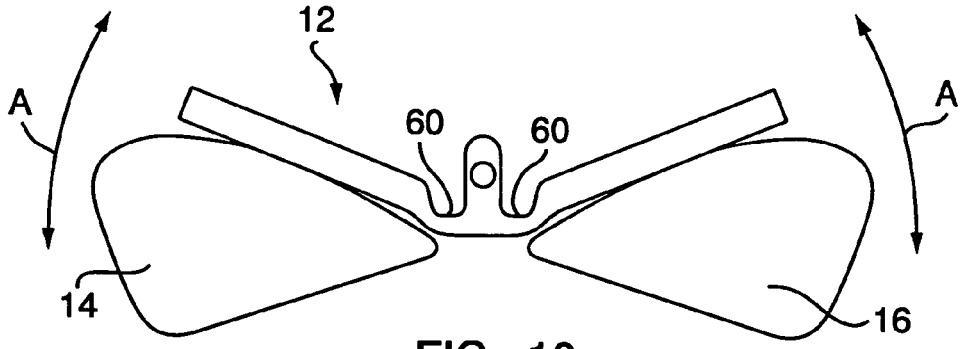
FIG. 10 is a side view of an embodiment of the present invention.

As shown in FIG. 10, the platform portion 12 can include a pair of areas of reduced cross-section 60, one adjacent to each of the first and second cartridge sections, 14 and 16 respectively. The areas of reduced cross section 60 allow the platform portion 12 to flex so that the first and second cartridge sections, 14 and 16 respectively, can move, as indicated by the arrows labeled "A", during a shaving operation to more closely follow the contours of a user's skin.

Figure 11:
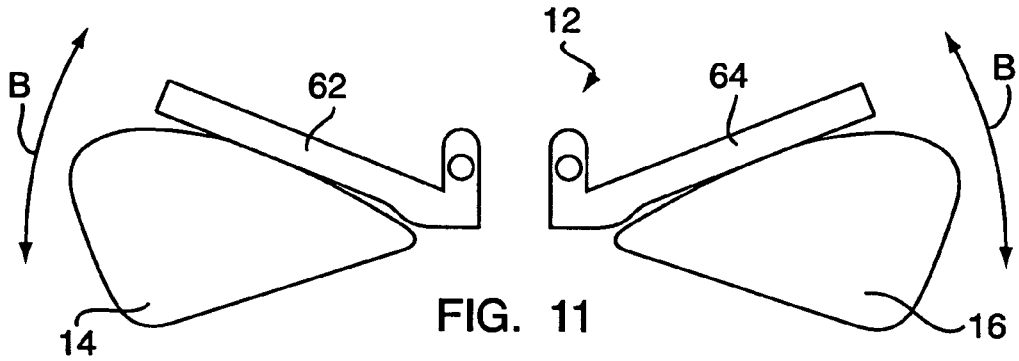
FIG. 11 is a side view of another embodiment of the present invention.
Figure 12:
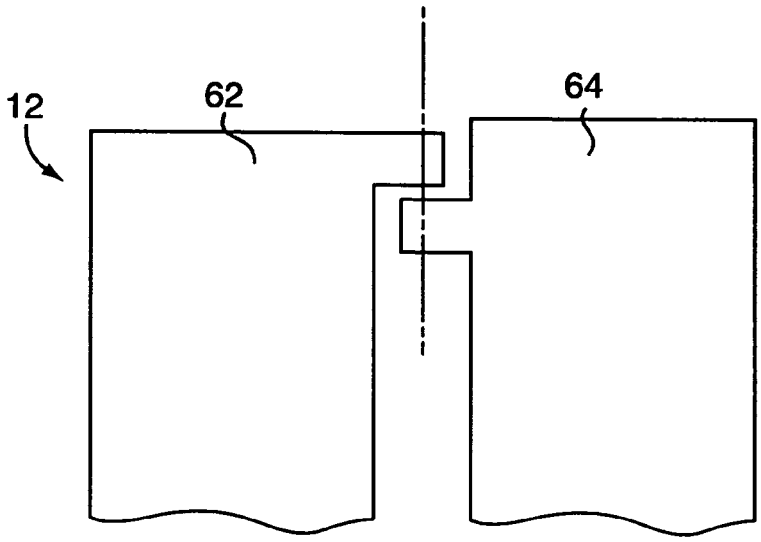
FIG. 12 is an enlarged partial view of the razor cartridge of FIG. 10.

Referring to FIGS. 11 and 12, the platform portion 12 is formed from first and second platform halves, 62 and 64 respectively, hingedly coupled to one another. Each platform half 62 and 64, is movable relative to the other, as indicated by the arrows labeled "B". Accordingly, during a shaving operation, the first and second platform halves 62 and 64 move to allow the cartridge sections mounted thereon to more closely follow the contours of a user's skin.

While preferred embodiments have been shown and described, various modifications and substitutions may be made without departing from the spirit and scope of the invention. Accordingly, it is to be understood that the present invention has been described by way of example, and not by limitation.

What is claimed is:

1. A razor cartridge comprising:

a platform portion having a first cartridge section including at least one first pair of razor blades positioned therein, each of said first pair of razor blades having an at least partially exposed cutting edge, and a second cartridge section coupled to said platform portion, said second cartridge section including at least one second pair of razor blades positioned therein, each of said second pair of razor blades having an at least partially exposed cutting edge, said first cartridge section including a first housing coupled to said platform portion, said first pair of razor blades being positioned in said first housing, and said second cartridge section including a second housing coupled to said platform portion, said second pair of razor blades being positioned in said second housing;

mounting means for rotatably coupling said platform portion to a handle; wherein said platform portion defines first and second limiting surfaces positioned on an underside thereof adjacent to a first end of said platform portion, and third and fourth limiting surfaces positioned on said underside of said platform portion adjacent to a second opposing end of said platform portion, said limiting surfaces being configured relative to one another to establish a range of rotational movement of said razor cartridge relative to a handle when said razor cartridge is rotatably mounted thereon; and wherein said cutting edges of said first pair of razor blades are positioned opposite and facing toward said cutting edges of said second pair of razor blades so that during a shaving operation, the razor cartridge can cut hair when drawn over a user's skin in either of two generally opposite directions.

2. A razor cartridge as defined by claim 1, wherein said platform portion and said first and second cartridge sections are integral with one another.

3. A razor cartridge as defined by claim 1, wherein said range of rotational movement is between 0° to approximately 90°.

4. A razor cartridge as defined by claim 1, wherein said range of rotational movement is approximately 70°.

5. A razor cartridge as defined by claim 1, wherein said range of rotational movement is approximately 45°.

6. A razor cartridge as defined by claim 1, wherein said range of rotational movement is approximately 90°.

7. A razor cartridge as defined by claim 1, wherein said platform portion defines a plurality of apertures extending there through to allow shaving debris to be washed from said razor cartridge.

8. A razor cartridge as defined by claim 1, wherein a first blade retainer having said first pair of razor blades coupled thereto is positioned in said first housing for movement between a neutral position and a retracted position; and a second blade retainer having said second pair of razor blades coupled thereto is positioned in said second housing for movement between a neutral position and a retracted position.

9. A razor cartridge as defined by claim 8, further comprising:

first biasing means positioned in said first housing for normally urging said first blade retainer toward said neutral position; and second biasing means positioned in said second housing for normally urging said second blade retainer toward said neutral position.

10. A razor cartridge as defined by claim 1, wherein said first and second cartridge sections define a gap there between.

11. A razor cartridge as defined by claim 10, wherein at least one comfort strip is positioned in said gap.

12. A razor cartridge as defined by claim 1, further comprising:

a first guard element coupled to said first housing adjacent a leading edge thereof; and a second guard element coupled to said second housing adjacent a leading edge thereof.

13. A razor cartridge as defined by claim 1, further comprising at least one comfort strip coupled to at least one of said first and second housings.

14. A razor cartridge as defined by claim 13, wherein said at least one comfort strip includes a pair of comfort strips one coupled to each of said first and second housings.

15. A razor cartridge as defined by claim 14, wherein said mounting means further includes an abutment surface engageable with a biasing member forming part of a handle so that when said razor cartridge is rotatably coupled to said handle for movement between a neutral and a fully rotated position, said biasing member engages said abutment surface and normally urges said razor cartridge toward said neutral position.

16. A razor cartridge as defined by claim 1, wherein said mounting means includes a pair of recesses one positioned at a first end of said platform portion and the other positioned at an opposing second end of said platform portion, said recesses each being adapted to slidably receive an end of a mounting arm forming part of a razor handle.

17. A razor cartridge as defined by claim 1, wherein said first cartridge section and said second cartridge section include different numbers of razor blades relative to one another.

18. A razor cartridge as defined by claim 1, wherein said first and second cartridge sections are releasably attachable to said platform portion.

19. A razor cartridge as defined by claim 1, wherein said first and second pairs of razor blades are each wire wrapped.

20. A razor cartridge as defined by claim 1, wherein said platform portion defines at least one flexible section adjacent at least one of said first and second cartridge sections so that during a shaving operation, part of said platform portion and thereby said cartridge section mounted thereon is movable via said flexible section to more closely follow the contours of a user's skin.

21. A razor cartridge as defined by claim 20, wherein said platform portion defines a pair of flexible sections one adjacent to each of said first and second cartridge sections so that during a shaving operation parts of said platform portion adjacent said flexible sections and thereby said first and second cartridge sections mounted thereon are moveable via said flexible sections to more closely follow the contours of a user's skin.

22. A shaving implement comprising a handle;

a razor cartridge coupled to said handle, said razor cartridge including:

a platform portion;

a first cartridge section coupled to said platform portion, said first cartridge section including at least one first pair of razor blades, each having an at least partially exposed cutting edge;

a second cartridge section coupled to said platform portion, said second cartridge section including at least one second pair of razor blades, each having an at least partially exposed cutting edge;

mounting means for rotatably coupling said platform portion to said handle; wherein said first cartridge section includes a first housing, and said at least one first pair of razor blades are positioned in said first housing, and said second cartridge section includes a second housing, and said at least one second pair of razor blades are positioned in said second housing; wherein said platform portion defines first and second limiting surfaces positioned on an underside thereof adjacent to a first end of said platform portion, and third and fourth limiting surfaces positioned on said underside of said platform portion adjacent to a second opposing end of said platform portion, said limiting surfaces being configured relative to one another to establish a range of rotational movement of said razor cartridge relative to said handle when said razor cartridge is rotatably mounted thereon; and wherein said cutting edges of said first pair of razor blades positioned in said first cartridge section are positioned opposite and facing toward said cutting edges of said second pair of razor blades positioned in said second cartridge section so that during a shaving operation, the razor cartridge can cut hair when drawn over a user's skin in either of two generally opposite directions.

23. A shaving implement as defined by claim 22, wherein said razor cartridge is rotatable forward and rearward relative to said handle between a neutral and a fully rotated position.

24. A shaving implement as defined by claim 23, wherein said razor cartridge when moving between said neutral and said fully rotated position encompasses a range of motion between 0° and 90°.

25. A shaving implement as defined by claim 22, wherein said handle includes means for releasably retaining said razor cartridge on said handle.

26. A shaving implement as defined by claim 25, wherein:

said handle includes a biasing member projecting outwardly from an end thereof; and said platform portion of said razor cartridge defines an abutment surface engageable with said biasing member to normally urge said razor cartridge toward a neutral position.

27. A shaving implement as defined by claim 22, wherein a range of rotation of said razor cartridge when moving from a neutral position to a fully rotated position encompasses approximately 90°.

28. A shaving implement as defined by claim 22, wherein said platform portion and said first and second cartridge sections are integral with one another.

29. A shaving implement as defined by claim 22, wherein said first and second cartridge section are releasably coupled to said platform portion.

30. A shaving implement as defined by claim 22, further comprising biasing means for normally urging said razor cartridge toward a neutral position.

31. A shaving implement as defined by claim 22, wherein said first and second pairs of blades are wire wrapped.

32. A shaving implement as defined by claim 23, wherein said razor cartridge is movable side-to-side relative to said handle.

* * * * *